US011892271B2

(12) United States Patent
Davidson et al.

(10) Patent No.: US 11,892,271 B2
(45) Date of Patent: Feb. 6, 2024

(54) ANTI-DRONE FIREWORK DEVICE

(71) Applicants: Utah State University Space Dynamics Laboratory, North Logan, UT (US); Fireworks West Internationale Inc, Logan, UT (US)

(72) Inventors: Morgan Davidson, River Heights, UT (US); Dustin Burch, Logan, UT (US)

(73) Assignees: UTAH STATE UNIVERSITY SPACE DYNAMICS LABORATORY, North Logan, UT (US); FIREWORKS WEST INTERNATIONALE INC, Logan, UT (US)

( * ) Notice: Subject to any disclaimer, the term of this patent is extended or adjusted under 35 U.S.C. 154(b) by 0 days.

(21) Appl. No.: 17/840,407

(22) Filed: Jun. 14, 2022

(65) Prior Publication Data

US 2023/0085735 A1 Mar. 23, 2023

Related U.S. Application Data

(60) Provisional application No. 63/202,505, filed on Jun. 14, 2021.

(51) Int. Cl.
*F41H 11/00* (2006.01)
*F42B 4/00* (2006.01)

(52) U.S. Cl.
CPC ..... *F41H 11/00* (2013.01); *F42B 4/00* (2013.01)

(58) Field of Classification Search
CPC .. F41H 11/02; F41H 11/04; F42B 5/15; F42B 12/70
See application file for complete search history.

(56) References Cited

U.S. PATENT DOCUMENTS

| | | | | |
|---|---|---|---|---|
| 8,205,537 | B1 | 6/2012 | Dupont | |
| 8,375,837 | B2 | 2/2013 | Gossen et al. | |
| 8,596,178 | B2 | 12/2013 | Rogers et al. | |
| 9,074,858 | B2 | 7/2015 | Yee et al. | |
| 10,435,153 | B2 | 10/2019 | Klein | |
| 10,689,109 | B2 | 1/2020 | Wypyszynski et al. | |
| 10,724,831 | B1 * | 7/2020 | Walker | F42B 12/56 |
| 11,175,118 | B1 * | 11/2021 | Manley | F42B 12/62 |

(Continued)

FOREIGN PATENT DOCUMENTS

EP 3109586 A1 12/2016

OTHER PUBLICATIONS

Whitaker, Overwatch Interceptor—UX, Airshare Systems, Inc., 2019.

*Primary Examiner* — J. Woodrow Eldred
(74) *Attorney, Agent, or Firm* — HOLLAND & HART LLP

(57) ABSTRACT

A counter-swarm firework includes a shell casing, multiple streamers positioned in the shell casing, a burst charge positioned in the shell casing and configured to disperse the multiple streamers from the shell casing when discharged, a pusher plate positioned in the shell casing between the burst charge and the multiple streamers, a fire suppressant layer positioned between the burst charge and the pusher plate, and a kick charge configured to launch the shell casing and its contents prior to discharging the burst charge. The fire suppression layer may be configured to suppress heat generated by the discharge of the burst charge.

20 Claims, 11 Drawing Sheets

(56) References Cited

U.S. PATENT DOCUMENTS

| | | | | |
|---|---|---|---|---|
| 2017/0219317 | A1 | 8/2017 | Sands | |
| 2019/0360783 | A1* | 11/2019 | Whittaker | F41H 13/0006 |
| 2020/0363165 | A1* | 11/2020 | Ang | F41H 11/02 |

* cited by examiner

ANTI-DRONE FIREWORK DEVICE

CROSS REFERENCE TO RELATED APPLICATIONS

This application claims the benefit of and priority to U.S. Provisional Patent Application No. 63/202,505, filed Jun. 14, 2021, which is hereby incorporated by reference in its entirety.

TECHNICAL FIELD

The present disclosure relates to counter-drone technologies, and more particularly to counter-drone devices and systems that deploy streamers that entangle propellers of a drone or unmanned aerial vehicle (UAV).

BACKGROUND

The use of unmanned aerial vehicles (UAVs—also referred to as drones) and unmanned aerial systems (UASs) has become more prevalent in many applications, including in military applications where the UAVs are used for surveillance and even deployment of artillery. Technologies and defenses have been developed to counter UAVs to reduce their impact in military and other settings. The counter-UAV efforts may also be referred to as counter-swarm or C-SWARM when engaging several UAVs. The counter-swarm community has developed consensus around the idea that a layered defense is a sensical approach. This approach provides higher likelihood of success against a wide range of threat scenarios through the application of complementary counter-swarm technologies. With this in mind, counter-swarm system architects are currently faced with difficult choices, often weighing competing factors in the search for appropriate combinations of technology to apply to each layer. Experts also agree that at least some of the innermost layers of a counter-swarm defense should include hard kill technologies (e.g., kinetic or directed energy) for close-in engagement. Requirements for an innermost layer of a counter-swarm defense may include consistent effectiveness, scalability, persistence for lasting effect in aerial denial, low-cost in comparison to the enemy swarm, and low collateral for use around blue force and/or civilians.

Examining leading close-in, hard kill counter-swarm technologies with these requirements in mind reveals that no existing systems are effective against swarms of UAVs. For example, guns, remote weapons systems (RWS), and similar kinetic systems are only effective against one target at a time. Therefore, serial engagement of individual swarm members using these technologies extends the counter-swarm time-to-intercept well past the point of practicality, even with modern swarm populations. Laser systems and high power microwaves suffer from similar serial targeting/engagement limitations, along with airspace deconfliction issues (e.g., for preventing fratricide) and high cost. Drone versus drone methods may be effective in small numbers, but quickly become unwieldy and expensive as the invading swarm size grows. Electronic warfare approaches have diminished in effectiveness over time, and they continue to do so in light of development of radio frequency (RF) dark drones/swarms.

Based on the current state of the art, in scenarios where the outermost areas of a counter-swarm system have been compromised by, for example, a massive or even moderately-sized swarm, today's counter-swam planners have no viable solutions. Enemy swarms have a higher likelihood of success in today's conflicts. As such, a need exists for a viable technology for use in the innermost layers of counter-swarm defenses that meet the requirements noted above.

SUMMARY

The use of optimized entanglement effectors have been shown to be a practical technology that delivers performance and affordability in counter-swarm scenarios while remaining persistent, scalable, and low collateral. This capability may help deter, dissuade, prevent, and/or stop adversaries from using military or terrorist swarm aggression against high value targets and interests. Because propellers on a UAV are standard features, entanglement of the propellers is one option for disabling the UAV. While propellers can be guarded by design, the fact remains that thrust is required for operation of UAVs, and air flow must be maintained in the production of thrust. If the propeller air flow is interrupted, the propeller can no longer provide the required thrust, and the UAV cannot continue to execute its mission. The present disclosure is directed to an optimized, persistent entanglement effector (e.g., a streamer or thread) for kinetic take-down of particular classes of UAVs. The material and geometry of the effectors are engineered such that every streamer is consistently effective in interrupting propeller thrust of the UAV if delivered to a location where entanglement with a propeller is most likely to occur. The effector may also be optimized for persistence in the air, relatively low cost, and scalable to many possible applications through selection of appropriate material and geometry. With such an effector in hand, delivery methods are then optimized to ensure relatively fast and appropriate deployment of a cloud of these effectors. The resulting geometry of the cloud of effectors is engineered to ensure a more optimal likelihood of interaction with UAV propellers while providing desired coverage. A single cloud of effectors can be deployed versus a low number of UAVs, or multiple clouds of effectors can be employed in optimal ways against swarms of UAVs. The solutions disclosed herein may provide a scalable, low-collateral approach that can be used in urban areas and around blue forces as well as in other more technical and/or combat areas.

Assuming that an optimized entanglement effector and appropriate delivery systems can be achieved in accordance with the principals disclosed herein, then counter-swarm system architects may have viable candidates for an innermost layer of a counter-swarm system. The technologies disclosed herein may directly reduce the significant risk currently posed by enemy UAV swarms thereby providing an effective counter-swarm layer. The solutions disclosed herein may provide a measurable benefit in a variety of applications including war fighter, homeland security, and law enforcement communities by providing a way to deter, dissuade, and/or prevent adversaries from using UAV swarm aggression.

One aspect of the present disclosure is directed to a counter-swarm firework that includes a casing, multiple streamers positioned in the casing, and a burst charge positioned in the casing and configured to deploy the multiple streamers when discharged. The multiple streamers may be optimized for propeller entanglement in a UAV. The multiple streamers may be optimized for clogging a propulsion air stream associated with a UAV. The multiple streamers may be biodegradable. The multiple streamers may each comprise a single piece of thin material that is rolled prior to being positioned in the casing. Each of the multiple streamers may include a single piece of thin material that has been rolled into sets of two or more rolls prior to being positioned in the casing.

Another aspect of the present disclosure is directed to a counter-swarm firework that includes a shell casing, multiple streamers positioned in the shell casing, a burst charge positioned in the shell casing and configured to disperse the multiple streamers from the shell casing when discharged, a pusher plate positioned in the shell casing between the burst charge and the multiple streamers, a fire suppressant layer positioned between the burst charge and the pusher plate, and a kick charge configured to launch the shell casing and its contents prior to discharging the burst charge. The fire suppression layer may be configured to suppress heat generated by the discharge of the burst charge.

The multiple streamers may be uniformly arranged to maximize the number of streamers filling the shell casing. In other arrangements, the multiple streamers may be randomly arranged and tightly packed into the shell casing. The counter-swarm firework may include a shell streamer attached to the shell casing, wherein the shell streamer is configured to orient the shell casing in a desired position upon discharge of the burst charge.

Additional aspects of the present disclosure are directed to a counter-swarm firework that includes a shell casing, multiple streamers, a burst charge, and a fire suppression material. The multiple streamers are positioned in the shell casing. The burst charge is positioned in the shell casing within the multiple steamers and configured to disperse the multiple streamers when discharged. The fire suppression material is positioned in the shell casing between the burst charge and the multiple streamers. The fire suppression material is configured to suppress the elevated temperatures in the shell casing caused by the discharge of the burst charge.

The fire suppression material may be arranged, at least in part, between the multiple streamers and the shell casing. Each of the material streamers may be wound in a roll. Each of the multiple streamers may be wound into a first roll with an additional second roll wrapped into an end of and wound around the first roll. Each of the multiple streamers may include a streamer dragline connecting multiple streamer drag sheets. The streamer dragline may include multiple streamer draglines connected the multiple streamer drag sheets. The counter-swarm firework may include a kick charge configured to launch the shell casing and the contents of the shell casing. The multiple streamers may include a paper and/or a plastic material. The burst charge may be positioned centrally within the shell casing and surrounded by the multiple streamers. A fire suppression material may be positioned between at least some of the multiple streamers.

BRIEF DESCRIPTION OF THE DRAWINGS

The foregoing features of the present invention will become more fully apparent from the following description and appended claims, taken in conjunction with the accompanying drawings. Understanding that these drawings depict only typical embodiments of the invention and are, therefore, not to be considered limiting of its scope, the invention will be described with additional specificity and detail through use of the accompanying drawings in which:

DETAILED DESCRIPTION

Figure 1:
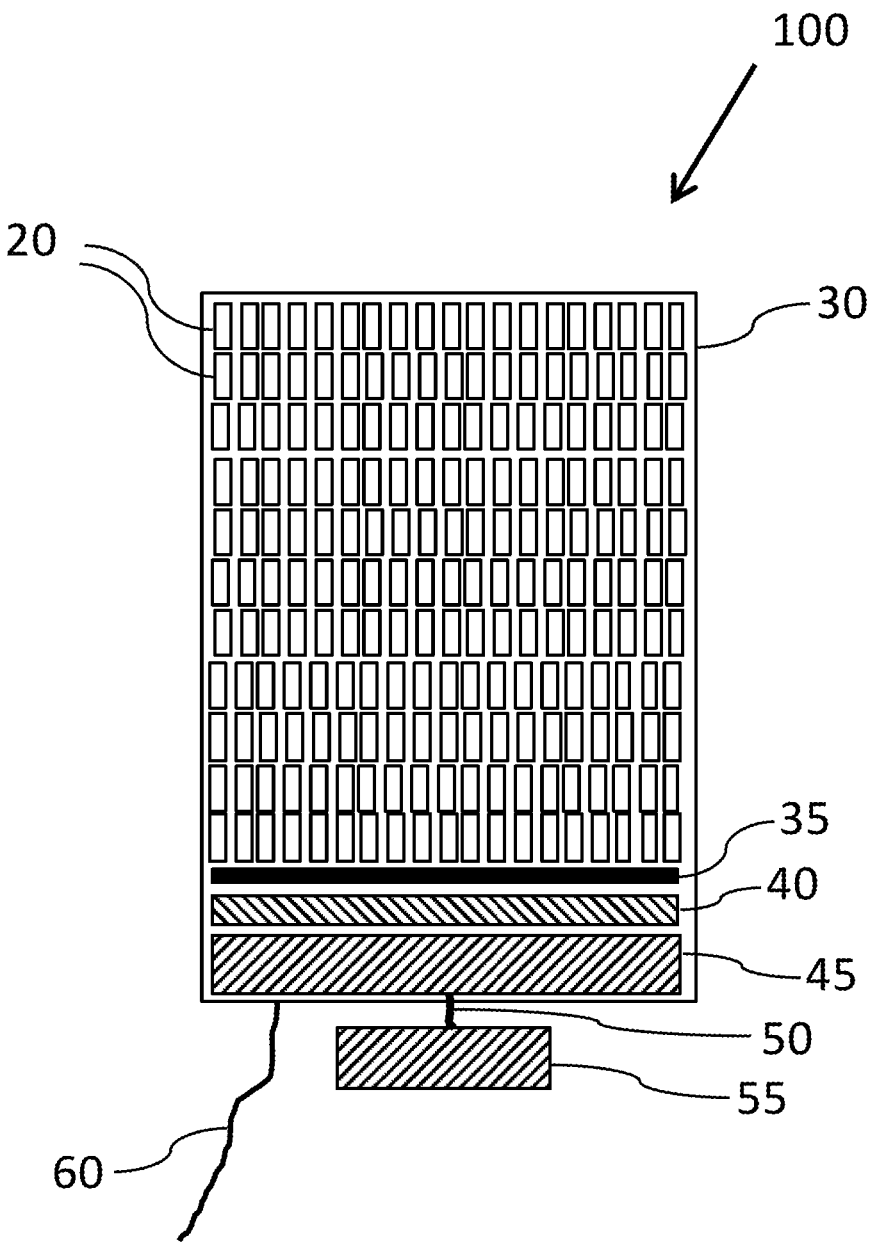
FIG. 1 is a schematic cross-sectional view of an example counter-swami firework in accordance with the present disclosure.

This description provides examples, and is not intended to limit the scope, applicability or configuration of the invention. Rather, the ensuing description will provide those skilled in the art with an enabling description for implementing embodiments of the invention. Various changes may be made in the function and arrangement of elements.

Thus, various embodiments may omit, substitute, or add various procedures or components as appropriate. For instance, it should be appreciated that the methods may be performed in an order different than that described, and that various steps may be added, omitted or combined. Also, aspects and elements described with respect to certain embodiments may be combined in various other embodiments. It should also be appreciated that the following systems, methods, and devices may individually or collectively be components of a larger system, wherein other procedures may take precedence over or otherwise modify their application.

The detailed description of exemplary embodiments herein makes reference to the accompanying drawings, which show exemplary embodiments by way of illustration. While these exemplary embodiments are described in sufficient detail to enable those skilled in the art to practice the disclosure, it should be understood that other embodiments may be realized and that logical changes and adaptations in design and construction may be made in accordance with this disclosure and the teachings herein without departing from the spirit and scope of the disclosure. Thus, the detailed description herein is presented for purposes of illustration only and not of limitation.

In various embodiments, with reference to the accompanying figures, the present disclosure generally provides for a counter-swarm device, system and/or methods. One example is directed to a counter-swarm device in the form of, for example, a firework. Other examples are directed to counter-UAV fireworks and/or firework systems, and related methods of operating the same.

The counter-swarm devices, systems and methods disclosed herein may make use of entanglement effectors intended to entangle within the propellers of a UAV. Various solutions disclosed herein illustrate the scalability of optimized entanglement effector technology for autonomous, area-based counter-swarm applications. The entanglement effector technologies may be implemented in the form of a firework or other device and/or system. For example, the entanglement effector may be deployed using a manually operated device for launching a projectile into the air, wherein the projectile once launched deploys the entanglement effectors in an airspace where the UAV is located. Other systems and methods may include autonomous features and/or functionality. For example, a system may detect the presence of a UAV within a predetermined airspace and launch one or more entanglement effector devices into the airspace and/or adjacent to the airspace. The system may automatically detect the UAV, track the UAV, detect other environmental conditions such as wind speed and/or wind direction, and parameters such as the altitude, speed, and direction of the UAV, and then launch one or more entanglement effector devices into or around the airspace in a direction and/or location that creates the best chance of the entanglement effectors interacting with the UAV propellers.

In some examples, the entanglement effector technology is embodied as a firework having a casing, a plurality of streamers positioned in the casing, a charge intended to deploy the streamers out of the casing, and other features and functionality that may best position the firework in the airspace where the streamers can interact with the propellers of one or more UAVs.

Referring now to FIG. 1, an example counter-swarm firework 100 is shown and described. The shell 100 includes a plurality of streamers 20 positioned within a shell casing 30. Also positioned within the shell casing 30 is a pusher plate 35, fire suppression material 40, and a burst charge 45. A kick charge 55 may be positioned outside of the shell casing 30 and connected to the burst charge 45 with a timing fuse 50. The shell 100 may also include a shell streamer 60 connected to the casing 30.

The plurality of streamers 20 may be wound as individual streamers and stacked in rows, columns and/or other specific arrangements within the casing 30. A variety of arrangements for the streamers 20, including connecting multiple streamers together which are wound together or the use of a string of streamers are possible, as will be described in further detail below.

The pusher plate 35 is typically positioned spatially between the streamers 20 and the burst charge 45. The pusher plate 35 may have a rigid construction so as to transfer forces from the burst charge 45 to dispense the streamers 20 from the casing 30. The pusher plate 35 may further prevent heat damage to the plurality of streamers 20 that may be caused by the detonation of the burst charge 45.

The fire suppression material 40 may be interposed spatially between the burst charge 45 and the streamers 20. The fire suppression material 40 may provide a boundary or layer that protects the streamers 20 from heat damage resulting from the burst charge 45. In some examples of the fire suppression material comprises a heat resistant material such as, for example, potassium bicarbonate, potassium bicarbonate with urea complex, or ammonium dihydrogen phosphate.

The kick charge 55 may be used to launch the shell 100 to a desired elevation. Operating the kick charge 55 may also ignite a timed fuse 50. The timed fuse 50 may be configured such that the burst charge 45 will ignite when the shell 100 is at its maximum height based on the parameter of the kick charge 55 and parameters of the remaining portions of the shell 100 (i.e., the size, weight, shape, etc.). The timed fuse 50 may also be configured to detonate the burst charge 45 at a pre-determined elevation and time necessary for the streamers 20 to occupy the anticipated airspace of an incoming UAV or swarm of UAVs, as described below.

The shell streamer 60 may provide multiple functions. For example, the shell streamer 60 may assist with visual tracking of the shell 100 after being launched. The shell streamer 60 may also assist with travel of the shell 100 in a relatively straight path. The shell streamer may also properly orient the shell 100 at the time of burst charge 45 detonation to maximize the dispersion of the streamers 20. The shell streamer 60 may comprise a plastic film material and have a length of about six inches to about 36 inches.

Figure 2:
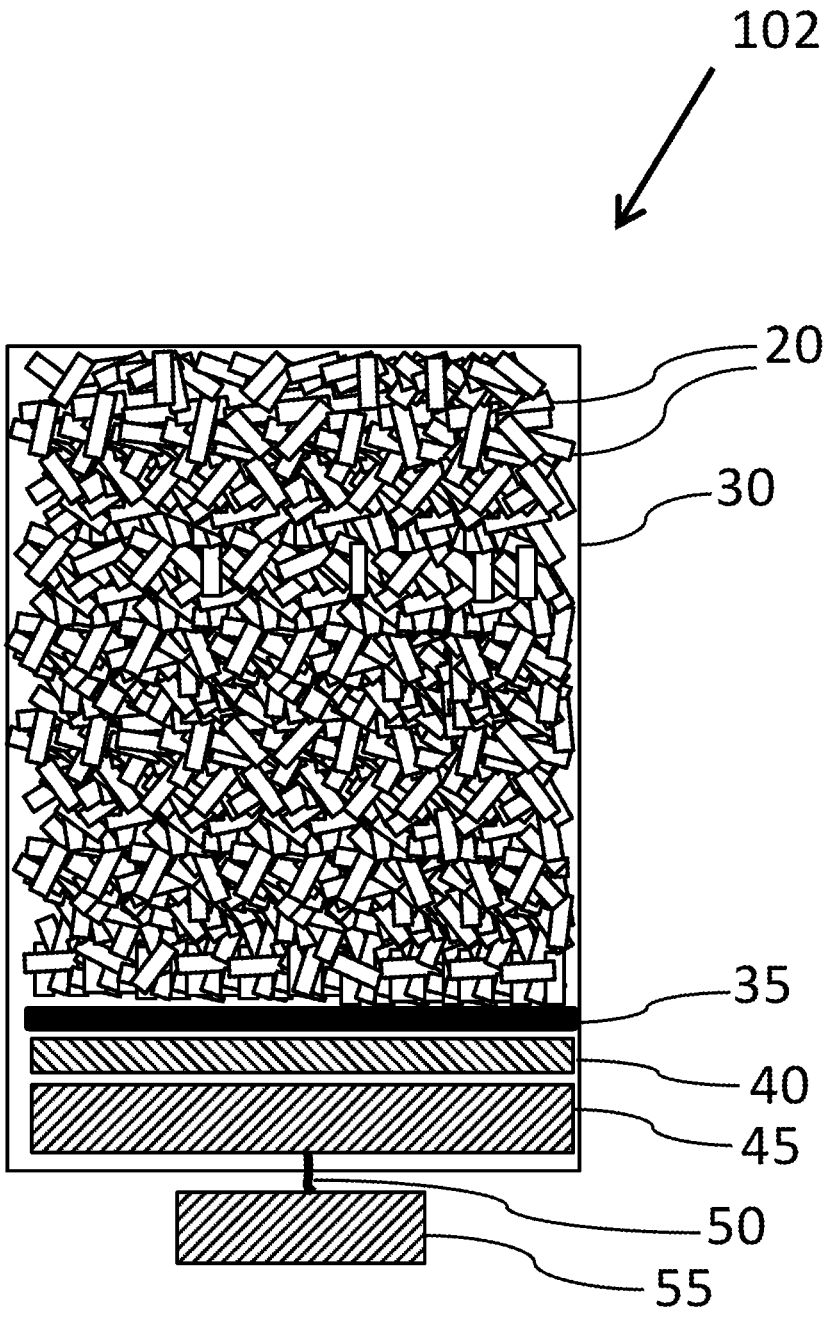
FIG. 2 is a schematic cross-sectional view of another example counter-swarm firework in accordance with the present disclosure.

FIG. 2 illustrates another example shell 102 in which the streamers 20 are randomly packed within the shell casing 30. The random orientation of the streamers 20 may make it easier to assemble and manufacture the shell 102 as compared to the specifically oriented rows and/or columns of the streamers 20 shown in FIG. 1. The shell 102 may or may not include the shell streamer 60 and/or other components such as the pusher plate 35, fire suppression material 40, etc.

Figure 3:
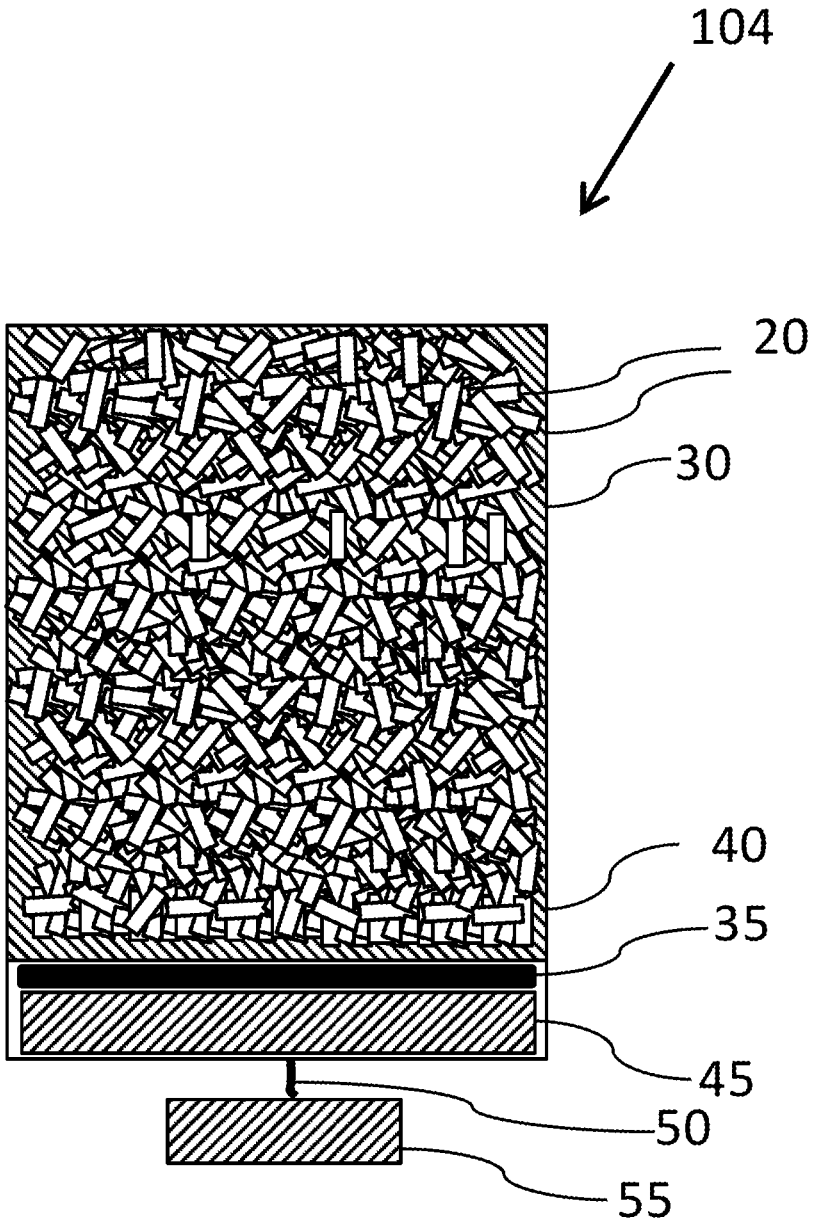
FIG. 3 is a schematic cross-sectional view of another example counter-swarm firework in accordance with the present disclosure.

FIG. 3 illustrates another example shell 104 wherein the fire suppression material 40 is arranged at a different location within the casing 30. The fire suppression material 40 may be interposed between the pusher plate 35 and the streamers 20. At least some of the fire suppression material 40 may be arranged between the streamers 20 themselves. Some of the fire suppression material 40 may be positioned between the shell casing 30 and the streamers 20 around all or at least some of the surfaces of the shell casing 30 to which the streamers 20 typically would be exposed. The arrangement of fire suppressing material 40 shown in FIG. 3 may be used in the other shells 100, 102 described above.

Figure 4A:
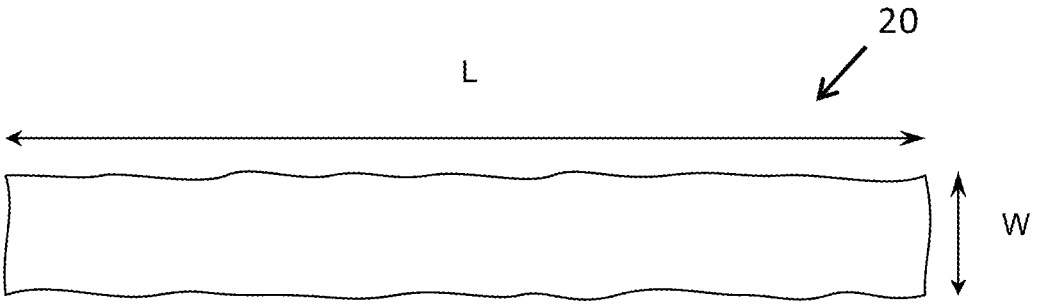
FIGS. 4A-4C show arrangements of an example streamer for use in the counter-swarm fireworks disclosed herein.

FIG. 4A shows an example streamer 20 having a length L and a width W. The streamer 20 may have a relatively thin thickness that is significantly less than the width or length. In at least some arrangements, the length of the streamer 20 is in the range of about 2 inches to about 96 inches, and more particularly in the range of about 36 inches to about 72 inches. The width is typically in the range of about 0.5 inches to about 2 inches, and more particularly in the range of about 0.5 inches to about 1 inch.

The streamer 20 may be optimized for persistence in an airspace once deployed as an entanglement effector. For example, a longer and wider streamer comprising a lightweight material may fall through an airspace more gradually providing greater opportunity to act as an entanglement effector against an incoming UAV or swarm of UAVs. The streamer 20 may be pre-deformed to fall at a desired rate, or may be shaped in other ways like loops or figure eight shapes to affect its persistence in the air. The streamer 20 may also be optimized for entanglement, with features such as perforations, appendages, mass concentrations, drag concentrations, pre-deformations or other configurations designed to increase the likelihood of entangling a propeller.

The length of a streamer 20 may change based on the size and range of UAV being targeted. For example, a longer streamer in the range of about 96 inches to 400 inches may be more suitable for a fixed-wing UAV with a pusher propeller as the streamer 20, falling slowly through an airspace as an entanglement effector, may be configured to wrap around the front of the UAV and entangle the propeller at the back of the UAV as the UAV passes through the airspace. Alternatively, multiple long streamers, e.g., such as those described below or having a length greater than about 96 inches, may wrap around the wings or control surfaces of a fixed-wing UAV creating sufficient drag on the UAV to significantly degrade its flight performance or disable it from flying. A long streamer 20 may clog air intakes of UAVs with shielded propellers or jet intakes. A shorter streamer 20 may work well against smaller UAVs, allowing for more coverage given shell 100 or 102 payload constraints.

Figure 4B:
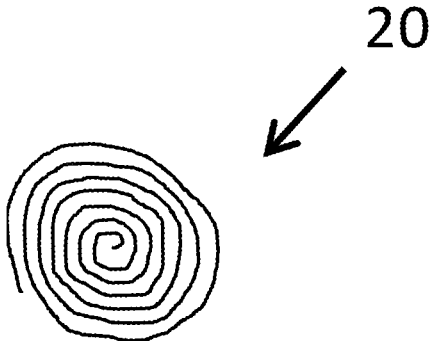
Figure 4C:
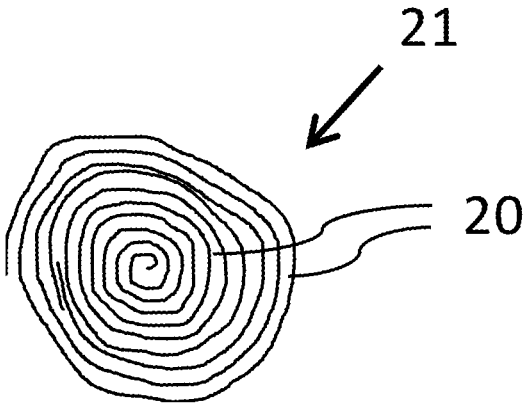

FIG. 4B shows a single streamer 20 rolled up as a single wound streamer. FIG. 4C shows a multi-wound streamer 21 that includes at least first and second streamers 20 that are wound one on top of the other. Other arrangements may include more than two streamers 20 that are wound up into a different multi-wound streamer configuration.

Figure 5A:
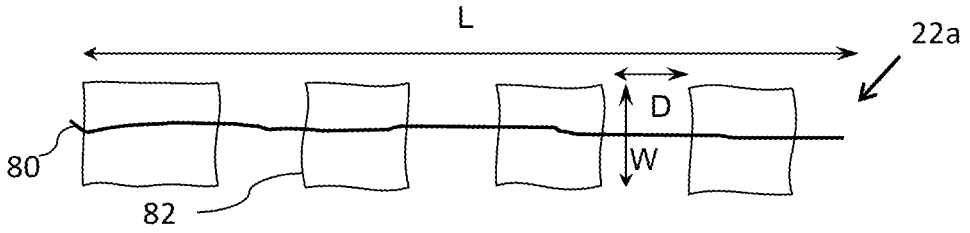
FIGS. 5A-5E show example drag sheets and streamer draglines in accordance with the present disclosure.

FIG. 5A shows a string streamer 22*a* that includes a plurality of streamer drag sheets 82 connected with a single streamer string line 80. Each of the streamer drag sheets 82 may have a width W and be spaced apart a distance D. The string streamer 22*a* may have a total length L. The string streamer 22*a* may have similar length and width dimensions as the streamer 22 described with reference to FIG. 4A. The distance D may be in the range of about 0.25 inches to about 3 inches, more particularly about 1 inch to about 2 inches. The distance W may be in the range of 0.25 to two inches.

Figure 5B:
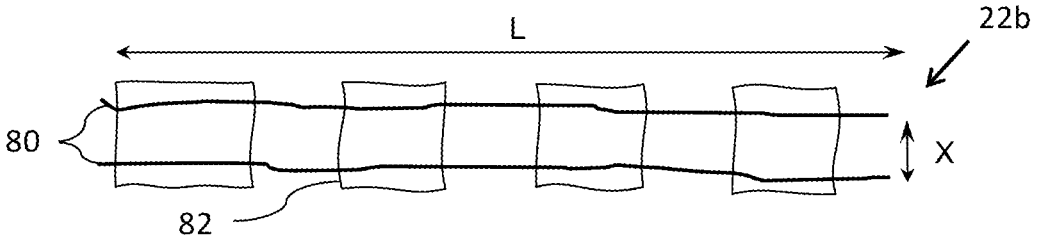
Figure 5C:
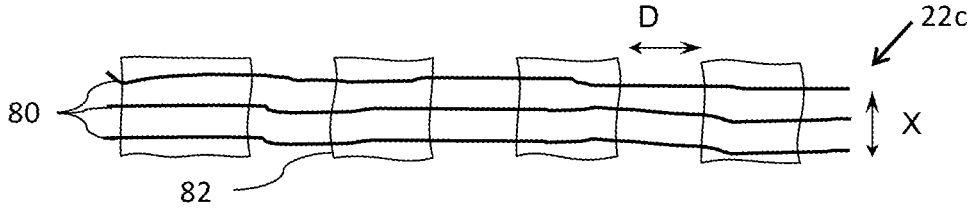

FIG. 5B shows another example string streamer 22*b* that includes multiple streamer drag sheets 82 connected with two streamer string lines 80. The string lines 80 may be spaced apart a distance x, wherein the distance x is typically less than the total width W of each individual streamer drag sheet 82. FIG. 5C shows another example string streamer 22*c* that includes a plurality of streamer drag sheets 82 that are connected with three or more streamer string lines 80. The additional string lines 80 may serve to strengthen the streamer 22*b* or 22*c* in operation as an entanglement effector.

Figure 5D:
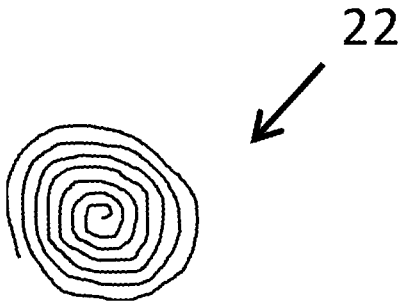
Figure 5E:
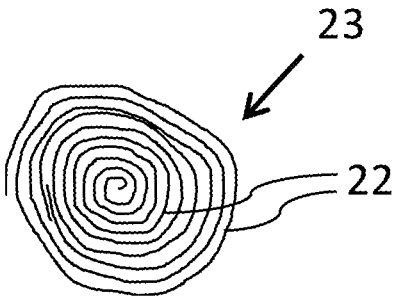

FIG. 5D shows a single one of the string streamers 22 rolled up to form a wound string streamer. FIG. 5E shows a plurality of string streamers 22 wound upon each other to create a multi-wound string streamers 23. Other arrangements may include three or more string streamers 22 that are wound upon each other to form a multi-wound string streamer 23.

Figure 6:
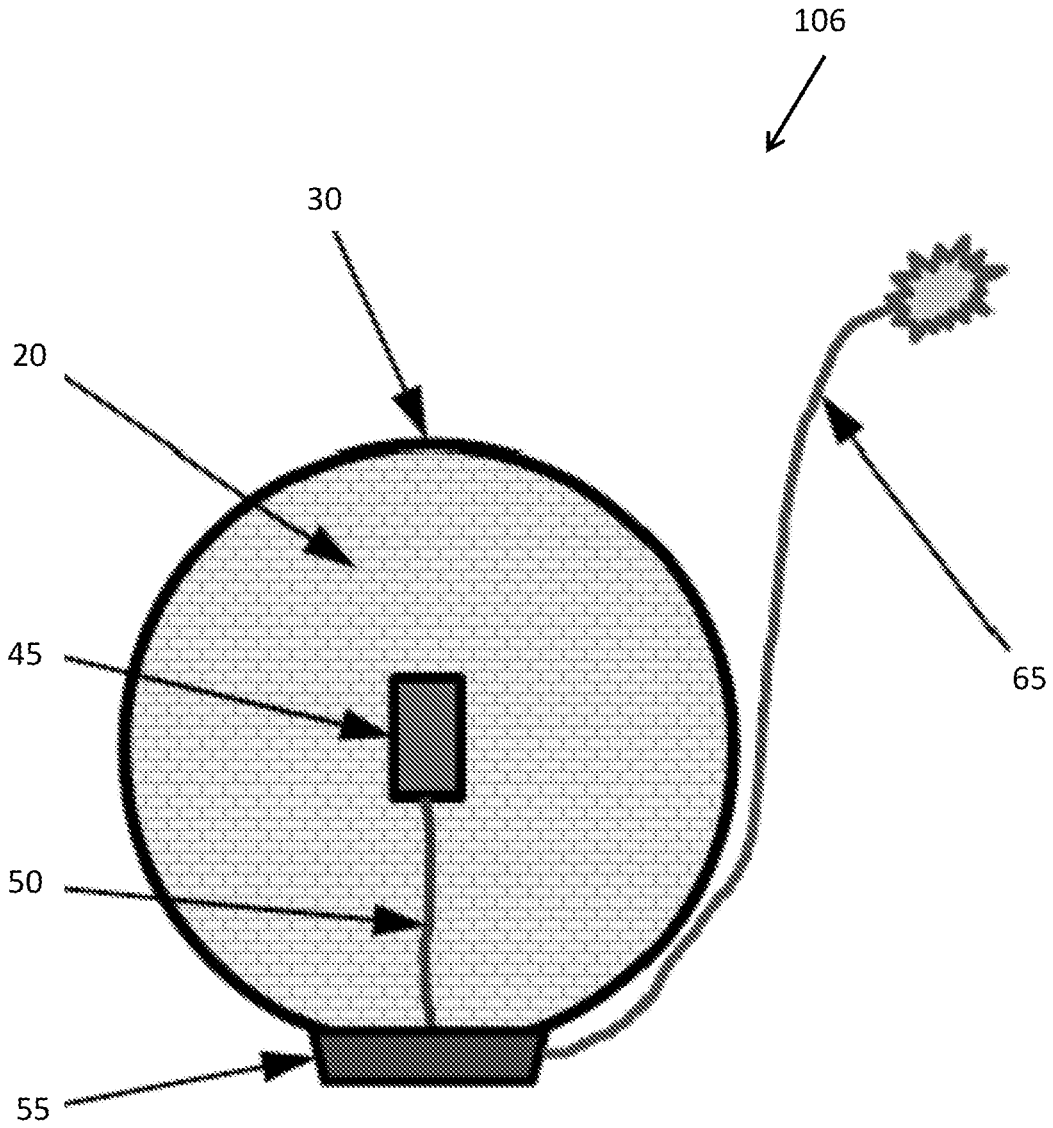
FIG. 6 is a schematic cross-sectional view of another example counter-swarm firework in accordance with the present disclosure.

Many other configurations are possible for the counter-drone fireworks disclosed herein. FIG. 6 shows another example shell 106 having a spherical shaped shell casing 30. A plurality of wound streamers 20 are positioned within the shell casing 30 along with a burst charge 45 and timed fuse 50. A kick charge 55 may be positioned on an exterior of the shell casing 30. A kick-charge fuse 65 may act to detonate the kick charge 55. Kick-charge fuse 65 may be a pyro fuse or an electronic fuse, e.g., an e-match.

The burst charge 45 is shown positioned centrally within the shell casing 30. The central location of the burst charge 45 may provide improved dispersion of the streamers 20 from the shell casing 30. The streamers 20 may be arranged in rows and/or columns as shown in FIG. 6, or may be positioned randomly within the shell casing 30, or some combination thereof.

Figure 7:
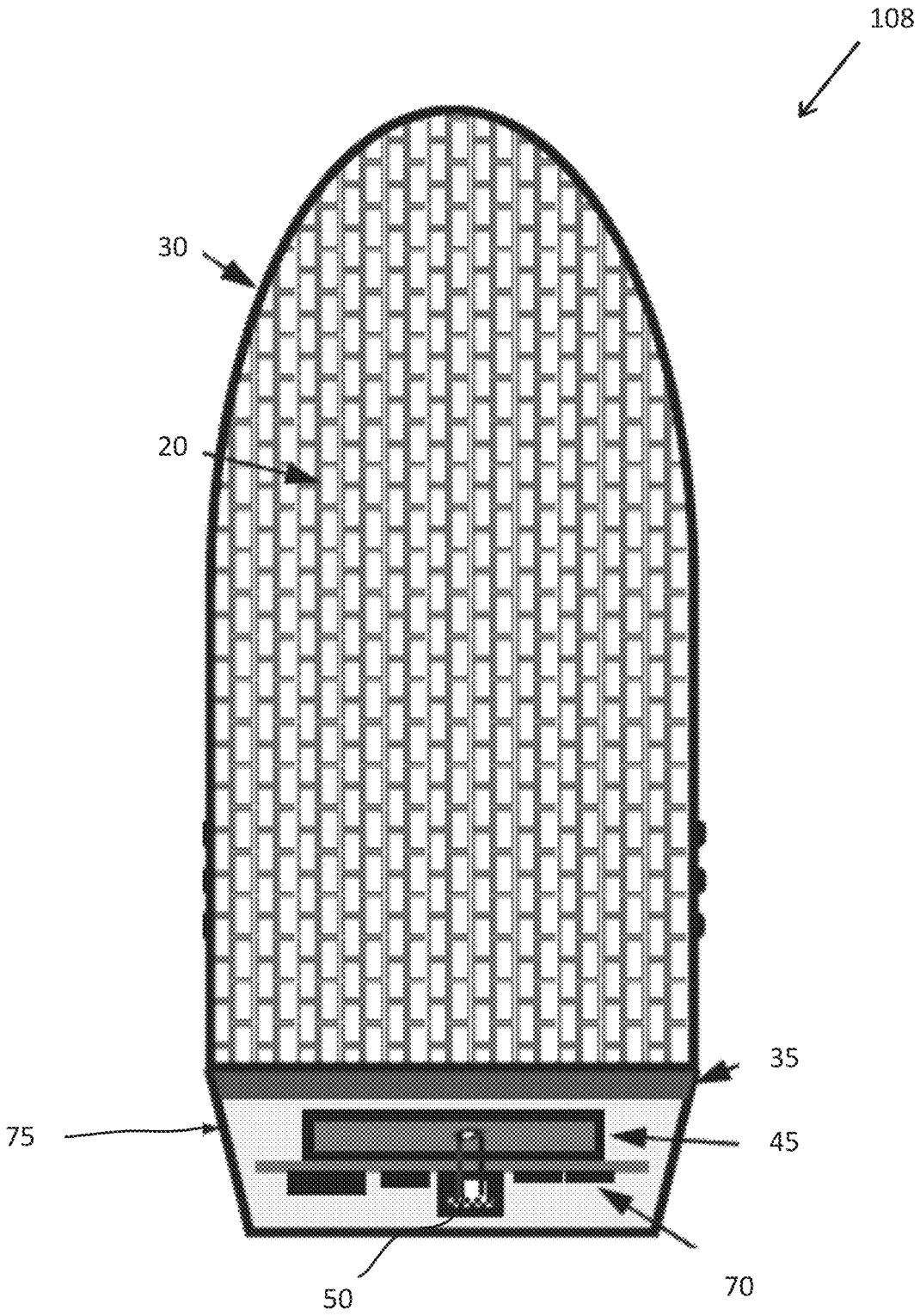
FIG. 7 is a schematic cross-sectional view of another example counter-swarm firework in accordance with the present disclosure.

FIG. 7 shows another example shell 108 having a ballistic shell shape for the outer casing 30. The shell 108 may also include a pusher plate 35, a burst charge 45, a timed fuse 50, a programmable control 70, and a tail 75. The programmable control 70 may provide improved optimization and/or customization of the burst charge firing and/or other operational aspects of the shell 108. The tail 75 may provide improved flight for the shell 108 and may provide a housing or space within which other features may be housed. The streamers 20 are shown positioned in rows and/or columns within shell casing 30. In other embodiments, the streamers 20 may be positioned randomly or a combination of random and organized arrangements. In all of the embodiments disclosed herein, the streamers 20 may be used in place of or in combination with multi-wound streamers 21, string streamers 22*b* or 22*c*, and/or multi-wound string streamers 23.

Figure 8:
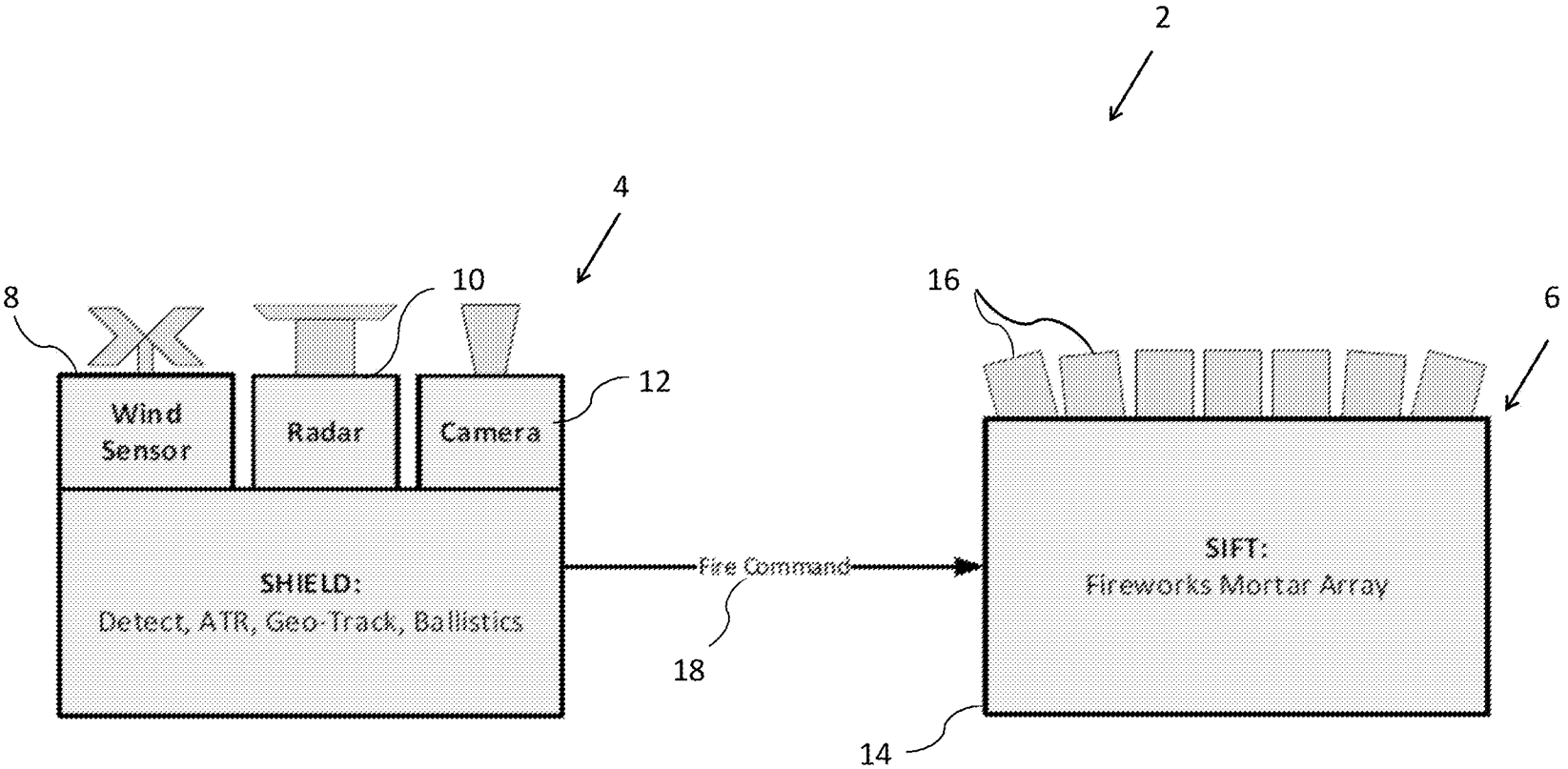
FIG. 8 is a schematic representation of an example counter-swarm system in accordance with the present disclosure.

FIG. 8 illustrates schematically an anti-drone system 2 that includes capability to detect and/or track UAVs within a predetermined airspace, and capability to fire one or more counter-drone firework devices into the airspace to bring down those UAVs. The anti-drone system 2 includes a detection module 4 and a launching module 6. The detection module 4 may include a wind sensor 8, a radar 10, a camera 12, and other capabilities. The detection module 4 may provide control signals such as a fire command 18 to the launching module 6. A launching module 6 may include a launching device 14 and a plurality of mortar tubes for launching fireworks shells 16. The mortar tubes for launching fireworks shells 16 may be arranged to launch in multiple directions or a single direction.

The command communications 18 may include any of a variety of commands, such as a command to launch one or more shells to a given height, at a certain time, in a certain direction, and/or a certain number of shells at a given time or a given sequence. The command communications 18 may be based on at least one of a wind speed and/or wind direction detected by the wind sensor 8, the presence of one or more UAVs and/or the location, including elevation, speed, direction of movement, etc. of one or more UAVs in an airspace as detected by the radar 10, and/or visual confirmation of one or more UAVs in the airspace as detected by the camera 12. The detection module 4 may include other capabilities such as a tracking system shotgun interdiction of enemy low-flying drones (SHIELD), AI-based automated target recognition (ATR), geo-tracking based upon a predefined geo-fence, and exterior ballistics information and/or capabilities.

The detection module 4 may be or include automated features that provide an autonomous solution that operates independently or in cooperation with other systems. For example, the tracking system may be used as a trip wire, checking for incursions through a predefined geo-fence. SHIELD may represent a remote weapons system (RWS) based kinetic counter-UAV solution that performs automated detection, AI-based automated target recognition, and/or geo-tracking of multiple UAV targets using radar and/or visual feedback. If a UAV impinges on the predefined geo-fence, the trip wire system of the detection module 4 may take exterior ballistics and local wind into account and provide command communications 18 for launching of the shells 16 from a fireworks mortar array to bring down the one or more UAVs that are detected in the airspace.

The system 2 may be mounted to a responsive precision pointing system and automatically fire programmable air burst shells to generate a formation of multiple streamer clouds over a predefined area or airspace. The system 2 or a combination of systems may use relatively precise pointing, ballistics, and wind effect prediction, along with a magazine of mortar tubes for firing fireworks shells 16 to provide simultaneous response to multiple incoming swarms and/or individual UAVs by deploying clouds of entanglement streamers that are appropriate to the engagement of UAVs present. This approach may help protect a wider area against hostile swarms of UAVs, and lends itself to mobile force protection. In addition, the system 2 can take down relatively low flying UAVs without firing directly at them due to the air burst capability and streamer fall rate provided by the system 2. With this in mind, the system 2 may execute a counter-swarm or counter-UAV mission from the ground level up to a predetermined elevation with a predetermined airspace.

In one example, such as the spherical shaped shells 106 described above, the shell casing 30 has a six-inch diameter and launch capability that can distribute streamers into an airspace of approximately 2,000 feet in horizontal diameter and up to 750 feet in altitude. A refined shell with a more aerodynamic shape such as the shell 108 described above with reference to FIG. 7 may extend the size of this protected airspace. If protection of such a large airspace is desired, then the initial cost of an automatic streamer system with a remote weapon system-based pointing system could become viable thanks to the targeted approach described herein in comparison with low tech firework mortar approach. For example, a streamer cannon could be used to launch the shells in a more sophisticated way that provides increased coverage, direction, and distance of launching and the like. The use of a launching cannon may be useful to avoid the simultaneously filling of an entire volume of airspace with streamers by using a more directed approach. This would allow for a more targeted delivery of multiple, optimized clouds of streamers anywhere in a protected airspace in response to multiple hostile UAVs and swarms with the expenditure of fewer shells.

Although one example shell has a six-inch diameter, other shell sizes and shapes may be possible. For example, the size and shape of a shell may be optimized for given sizes and shapes of streamers, total number of streamers, weight of the shell, recoil forces involved with the shell size at deployment and the related burst charge needed, and other features and considerations.

Figure 9:
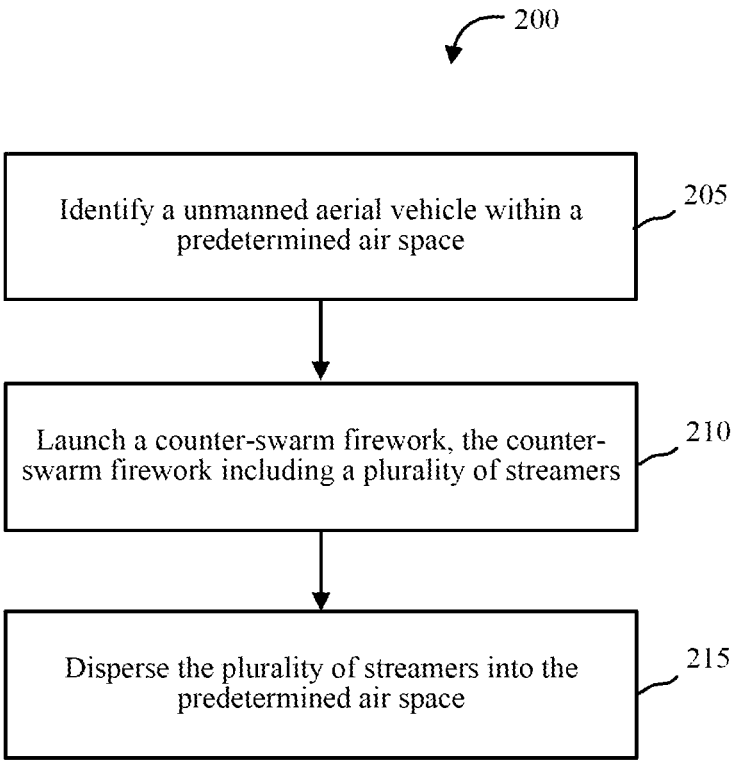
FIG. 9 is a flow diagram showing steps of an example method of operating a counter-swarm device or system in accordance with the present disclosure.

Referring now to FIG. 9, an example method 200 related to a counter-drone system using streamers deployed into an airspace is described. Method 200 includes, in an initial step 205, identifying an unmanned aerial vehicle within a predetermined airspace. At block 210, the method 200 includes launching a counter-swarm firework, wherein the counter-swarm firework includes a plurality of streamers. The plurality of streamers are dispersed into the predetermined airspace in a step 215. Other steps may include launching additional fireworks into the airspace. Each of the launched counter-swarm fireworks may be directed to a predetermined elevation and/or direction based on the identified location or other parameters associated with the identified unmanned aerial vehicle (e.g., direction of travel, speed of travel, elevation, number of vehicles detected, etc.).

Figure 10:
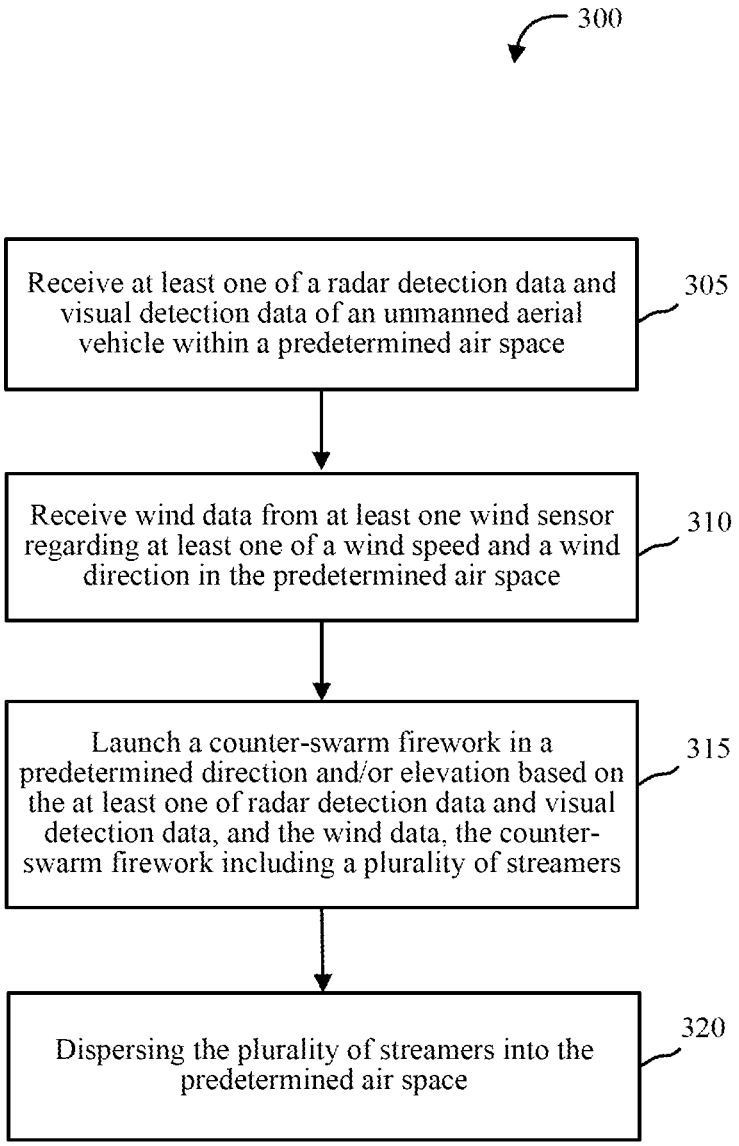
FIG. 10 is a flow diagram showing steps of another example method of operating a counter-swarm device or system in accordance with the present disclosure.
Figure 11:
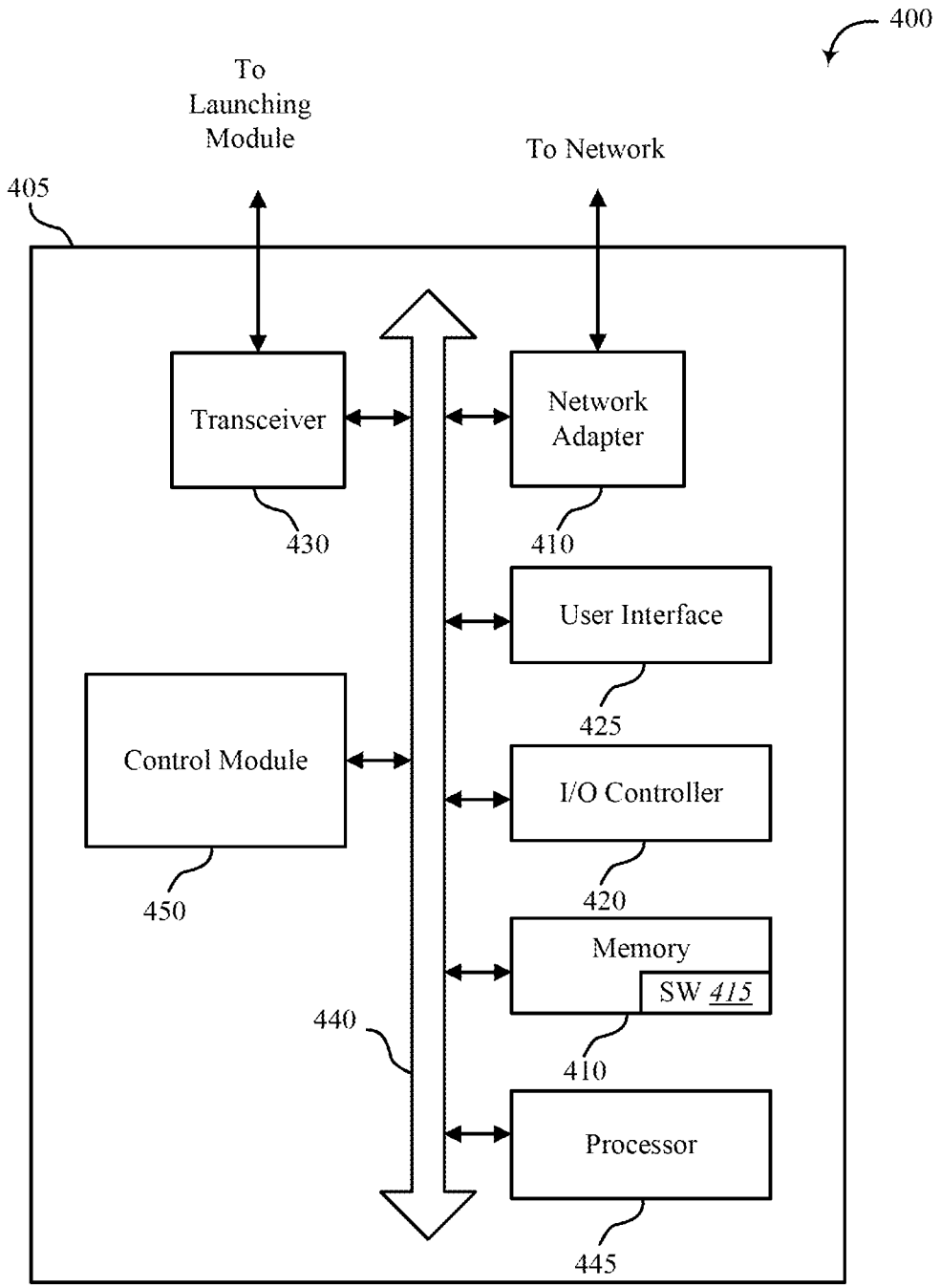
FIG. 11 is a schematic view of an example computer system in accordance with the present disclosure.

FIG. 10 shows another example method 300. The method 300 includes receiving at least one of radar detection data and visual detection data of an unmanned aerial vehicle within a predetermined airspace. At block 310, the method 300 includes receiving wind data from at least one wind sensor regarding at least one of a wind speed and a wind direction in the predetermined airspace. Block 315 includes launching a counter-swarm firework in a predetermined direction and/or to a predetermined elevation based on at least one of radar detection data and visual connection data, and the wind data. The counter-swarm firework includes a plurality of streamers. At block 320, the method includes dispersing the plurality of streamers into the predetermined airspace. The method 300 may include additional steps such as launching multiple counter-swarm fireworks. The dispersed streamers may engage with the propellers of the unmanned aerial vehicle to disable the vehicle from flying.

The foregoing description, for purpose of explanation, has been described with reference to specific embodiments. However, the illustrative discussions above are not intended to be exhaustive or to limit the invention to the precise forms disclosed. Many modifications and variations are possible in view of the above teachings. The embodiments were chosen and described in order to best explain the principles of the present systems and methods and their practical applications, to thereby enable others skilled in the art to best utilize the present systems and methods and various embodiments with various modifications as may be suited to the particular use contemplated.

Unless otherwise noted, the terms "a" or "an," as used in the specification and claims, are to be construed as meaning "at least one of" In addition, for ease of use, the words "including" and "having," as used in the specification and claims, are interchangeable with and have the same meaning as the word "comprising." In addition, the term "based on" as used in the specification and the claims is to be construed as meaning "based at least upon." All ranges disclosed herein include, unless specifically indicated, all endpoints and intermediate values. In addition, "optional", "optionally", or "or" refer, for example, to instances in which subsequently described circumstance may or may not occur, and include instances in which the circumstance occurs and instances in which the circumstance does not occur. The terms "one or more" and "at least one" refer, for example, to instances in which one of the subsequently described circumstances occurs, and to instances in which more than one of the subsequently described circumstances occurs.

What is claimed is:

1. A counter-swarm firework, comprising:

a casing;

multiple streamers positioned in the casing;

a burst charge positioned centrally within the casing, surrounded by the multiple streamers, and configured to disperse the multiple streamers when discharged.

2. The counter-swarm firework of claim 1, wherein the multiple streamers are configured for propeller entanglement.

3. The counter-swarm firework of claim 1, wherein the multiple streamers are configured for clogging a propulsion airstream.

4. The counter-swarm firework of claim 1, wherein the multiple streamers are biodegradable.

5. The counter-swarm firework of claim 1, wherein each of the multiple streamers are comprised of a single piece of thin material that is rolled prior to being positioned in the casing.

6. The counter-swarm firework of claim 1, wherein each of the multiple streamers are comprised of a single piece of material that has been rolled in sets of two or more rolls prior to being positioned in the casing.

7. A counter-swarm firework, comprising:

a shell casing;

multiple streamers positioned in the shell casing;

a burst charge positioned centrally within the shell casing, surrounded by the multiple streamers, and configured to disperse the multiple streamers from the shell casing when discharged;

a pusher plate positioned in the shell casing between the burst charge and the multiple streamers;

a fire-suppression layer positioned between the burst charge and the pusher plate, the fire-suppression layer configured to suppress heat generated by the discharge of the burst charge; and a kick charge configured to launch the shell casing and its contents prior to discharging the burst charge.

8. The counter-swarm firework of claim 7, wherein the multiple streamers are arranged within the casing to maximize a total number of streamers filling the shell casing.

9. The counter-swarm firework of claim 7, wherein the multiple streamers are randomly arranged and packed into the shell casing.

10. The counter-swarm firework of claim 7, further comprising a shell streamer attached to the shell casing and configured to orient the shell casing in a desired position upon discharge of the burst charge.

11. A counter-swarm firework, comprising:

a shell casing;

multiple streamers positioned in the shell casing;

a burst charge positioned centrally within the shell casing and surrounded by the multiple streamers and configured to disperse the multiple streamers when discharged; and fire-suppression materials positioned in the shell casing between the burst charge and the multiple streamers, the fire-suppression materials configured to suppress elevated temperatures in the shell casing caused by the discharge of the burst charge.

12. The counter-swarm firework of claim 11, wherein the fire-suppression materials are dispersed between the multiple streamers in the shell casing.

13. The counter-swarm firework of claim 11, wherein each of the multiple streamers is wound in a roll.

14. The counter-swarm firework of claim 11, wherein each of the multiple streamers is wound into a first roll with an additional second roll wrapped into an end of and wound around the first roll.

15. The counter-swarm firework of claim 11, wherein each of the multiple streamers comprises a streamer drag line connecting multiple streamer drag sheets.

16. The counter-swarm firework of claim 15, wherein the streamer drag line comprises multiple streamer drag lines connecting the multiple streamer drag sheets.

17. The counter-swarm firework of claim 11, further comprising a kick charge configured to launch the shell casing and contents of the shell casing.

18. The counter-swarm firework of claim 11, wherein the multiple streamers are configured for persistence in an airspace.

19. The counter-swarm firework of claim 11, wherein the fire-suppression materials are positioned between at least some of the multiple streamers.

20. The counter-swarm firework of claim 1, wherein the multiple streamers are configured for persistence in the air.

* * * * *